US006575251B2

(12) United States Patent
Watson et al.

(10) Patent No.: US 6,575,251 B2
(45) Date of Patent: Jun. 10, 2003

(54) GRAVEL INFLATED ISOLATION PACKER

(75) Inventors: Graham Watson, Houston, TX (US); Gary Hurst, Lake Jackson, TX (US); H. Steven Bissonnette, Sugar Land, TX (US); Geoffrey Kernick, Aberdeen (GB); Colin Price-Smith, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 28 days.

(21) Appl. No.: 09/880,376

(22) Filed: Jun. 13, 2001

(65) Prior Publication Data

US 2002/0189821 A1 Dec. 19, 2002

(51) Int. Cl.[7] ..... E21B 33/127
(52) U.S. Cl. ..... 166/387; 166/133; 166/183
(58) Field of Search ..... 166/387, 129, 166/131, 133, 183, 191, 285

(56) References Cited

U.S. PATENT DOCUMENTS 2,618,344 A * 11/1952 Turechek et al. ..... 166/117
3,301,329 A 1/1967 Martin
3,460,618 A 8/1969 Blagg
3,578,083 A 5/1971 Anderson
4,155,404 A * 5/1979 Hollingsworth ..... 166/187
4,484,626 A 11/1984 Kerfoot et al.
4,519,451 A * 5/1985 Gray et al. ..... 166/131
4,832,129 A * 5/1989 Sproul et al. ..... 166/120
5,186,258 A 2/1993 Wood et al.
5,271,469 A * 12/1993 Brooks et al. ..... 166/187
6,009,951 A * 1/2000 Coronado et al. ..... 166/127
6,050,336 A * 4/2000 Willauer et al. ..... 166/117

* cited by examiner

*Primary Examiner*—David Bagnell
*Assistant Examiner*—Daniel P Stephenson
(74) *Attorney, Agent, or Firm*—Williams, Morgan & Amerson, P.C.; Jeffrey E. Griffin; Brigitte L. Jeffery

(57) ABSTRACT

The present invention discloses apparatus and methods for use in wellbores that comprise an inflatable element. The inflatable element is adapted for inflation by gravel. One embodiment of the invention is a method of sealing an annulus in a well that comprises expanding the inflatable element with a gravel laden slurry. The inflatable element comprises a passageway communicating between an exterior and an interior of the inflatable element. The inflatable element is capable of being connected to a sand screen and the inflatable element can be inflated with the gravel laden slurry during a gravel packing of the well.

66 Claims, 7 Drawing Sheets

GRAVEL INFLATED ISOLATION PACKER

BACKGROUND OF THE INVENTION

1. Field of the Invention

This invention relates generally to tools used to complete subterranean wells and in particular to hydraulically actuated inflatable packers.

2. Description of Related Art

Hydrocarbon fluids such as oil and natural gas are obtained from a subterranean geologic formation, referred to as a reservoir, by drilling a well that penetrates the hydrocarbon-bearing formation. Once a wellbore has been drilled, the well must be completed before hydrocarbons can be produced from the well. A completion involves the design, selection, and installation of equipment and materials in or around the wellbore for conveying, pumping, or controlling the production or injection of fluids. After the well has been completed, production of oil and gas can begin.

Sand or silt flowing into the wellbore from unconsolidated formations can lead to an accumulation of fill within the wellbore, reduced production rates and damage to subsurface production equipment. Migrating sand has the possibility of packing off around the subsurface production equipment, or may enter the production tubing and become carried into the production equipment. Due to its highly abrasive nature, sand contained within production streams can result in the erosion of tubing, flowlines, valves and processing equipment. The problems caused by sand production can significantly increase operational and maintenance expenses and can lead to a total loss of the well. One means of controlling sand production is the placement of relatively large sand (i.e., "gravel") around the exterior of a slotted, perforated, or other type liner or screen. The gravel serves as a filter to help assure that formation fines and sand do not migrate with the produced fluids into the wellbore. In a typical gravel pack completion, a screen is placed in the wellbore and positioned within the unconsolidated formation that is to be completed for production. The screen is typically connected to a tool that includes a production packer and a cross-over, and the tool is in turn connected to a work or production tubing string. The gravel is pumped in a slurry down the tubing and through the cross-over, thereby flowing into the annulus between the screen and the wellbore. The liquid forming the slurry leaks off into the formation and/or through the screen, which is sized to prevent the sand in the slurry from flowing through. As a result, the sand is deposited in the annulus around the screen where it forms a gravel pack. The screen prevents the gravel pack from entering into the production tubing. It is important to size the gravel for proper containment of the formation sand, and the screen must be designed in a manner to prevent the flow of the gravel through the screen.

A problem that is frequently encountered during a well completion is the need to seal off sections of the wellbore. These sections can include areas in which an adequate gravel pack can not be obtained, such as below the bottom of the gravel pack screens where adequate circulation is difficult to achieve. In some formations, such as across a major or minor shale section, a gravel pack completion is not desirable. Sections of the hole that are not going to be completed often need to be isolated from the sections that will be completed. If these areas that are not going to be completed were left open, the gravel which is tightly packed around the gravel pack screens after a gravel pack may be able to migrate to these void areas, thereby losing the protection provided by the gravel pack completion. Once the well is placed on production, the flow of produced fluids may accelerate the gravel migration by having a fluidizing effect on the gravel. This migration could expose the screens to direct production of formation sand and could result in equipment damage, formation collapse and even the loss of the well.

Inflatable packers that comprise an inner elastomeric bladder are well known in the industry and have been used in attempts to seal off sections of a wellbore for the reasons discussed above. The bladder defines a chamber that contains a pressurized fluid which is used to inflate the packer while an exterior elastomeric body seals against the wellbore and prohibits fluid flow past the packer when in its inflated condition. Problems with inflatable packers include the possibility of bladder rupture, incomplete inflation, long term compressibility and seal leaks, any of which can deflate the bladder and result in the loss of a seal between the packer body and the wellbore. Other factors that can affect the inflatable packer reliability include elevated temperatures, pressure differentials, hole roughness and the need for the packer to maintain the seal for an extended period of time.

There is a need for improved tools and methods to increase the reliability of inflatable packers for these applications and to address the problems referred to above.

SUMMARY OF THE INVENTION

The present invention discloses apparatus and methods for use in wellbores that comprise an inflatable element. The inflatable element is adapted for inflation by gravel, preferably by a gravel laden slurry.

One embodiment of the present invention is a well completion comprising a sand screen and a gravel inflatable element. The gravel inflatable element can be capable of movement between a deflated state and an inflated state and can be inflated by a gravel laden slurry. The gravel inflatable element can comprise a top end, a bottom end, and an interior. The gravel inflatable element may further comprise a passageway allowing communication of a gravel laden slurry between the top end of the gravel inflatable element and the interior of the gravel inflatable element. The gravel inflatable element can also comprise a passageway allowing communication of the gravel laden slurry between the bottom end of the gravel inflatable element and the interior of the gravel inflatable element. The passageway may include a check valve that restricts reverse flow. In one embodiment the well completion comprises a first sand screen and a second sand screen and the gravel inflatable element can isolate the first sand screen from the second sand screen. In another embodiment the gravel inflatable element can be placed below the sand screen and isolate the sand screen from the well below the gravel inflatable element.

Another embodiment is a well tool comprising an inflatable element and a passageway communicating between an exterior and an interior of the inflatable element. The inflatable element is adapted for inflation by gravel provided through the passageway. The passageway can comprise at least one shunt tube and also a check valve that restricts reverse flow. The well tool may also comprise a first sand screen and a second sand screen with the inflatable element isolating the first sand screen from the second sand screen. The well tool is capable of being placed below the lowermost sand screen and isolate the lowermost sand screen from the well below the inflatable element.

Yet another embodiment is an apparatus comprising a tubular body member having first and second segments, each segment having an exterior and a longitudinal bore extending therethrough. A bladder is surrounding the second segment of the tubular body, the bladder having a wall and an interior. A conduit is located adjacent to the exterior of the first segment and extends through the wall of the bladder element. The conduit allows a gravel laden slurry to enter and expand the bladder and may include a check valve that restricts reverse flow. The bladder is capable of being attached to the tubular body member and expanded in a radial direction. The bladder has an upper end and a lower end, both of which are capable of being connected to the tubular body member. The second tubular body segment can comprise an upper packer head and a lower packer head, where the bladder upper end is connected to the upper packer head and the bladder lower end is connected to the lower packer head.

The conduit may extend through the upper packer head and communicate between the exterior of the first segment of the tubular body member and the interior of the bladder. It is possible for the conduit to extend through the upper and lower packer heads and communicate between the exterior of the first and third segments of the tubular body member and the interior of the bladder. At least one aperture may be present in the second segment of the tubular body member that provide fluids communication between the longitudinal bore of the tubular body member and the interior of the bladder. The apertures allow fluid communication but restrict particulate communication. The conduit enables communication between the exterior of the first segment of the tubular body member and the interior of the bladder. In a particular embodiment the apparatus further comprises a third segment of the tubular body member wherein the conduit enables communication between the exterior of the first and third segments with the interior of the bladder. The bladder may be constructed from a material that allows the passage of fluid but restricts the passage of particulates.

Still another embodiment is a wellbore isolation tool comprising a tubular body having a longitudinal bore, an expandable bladder attached to the tubular body and a conduit providing communication between the expandable bladder and the exterior of the tubular body. The conduit allows a gravel laden slurry to enter and expand the bladder and may comprise a check valve that restricts reverse flow. The bladder can have an upper end and a lower end where both the upper end and the lower end are connected to the tubular body. The expandable bladder may enclose a portion of the tubular body comprising at least one aperture. The apertures assist the dehydration of the gravel laden slurry by allowing fluid flow from the gravel laden slurry within the expandable bladder through the apertures in the tubular body and into the longitudinal bore of the tubular body. The apertures allow fluid communication while at the same time restricting particulate communication. The conduit can also include a check valve that restricts reverse flow.

One particular embodiment of the present invention is an apparatus comprising a tubular body member having first, second and third segments. The first and third segments being on opposite ends of the second segment and each segment having an exterior and a longitudinal bore extending therethrough. A bladder surrounds the second segment of the tubular body, the bladder having a wall and an interior. A conduit is located adjacent the first and third segments and extends through the wall of the bladder. The conduit allows a gravel laden slurry to enter and expand the bladder. The conduit enables communication between the exterior of the first and third segments with the interior of the bladder and may include a check valve to restrict reverse flow. During a gravel pack completion of a wellbore the conduit allows gravel laden slurry to communicate between the exterior of the first and third segments and the interior of the bladder. The second segment of the tubular body may comprise at least one aperture that assists the dehydration of the gravel laden slurry within the bladder. The apertures allow fluid communication while restricting particulate communication. The bladder is capable of radial expansion upon being filled with gravel. The expanded bladder can form a seal between the tubular body and the wellbore wall.

Another particular embodiment of the invention is a method of sealing an annulus in a well that comprises expanding an inflatable element with a gravel laden slurry. The inflatable element comprises a passageway communicating between an exterior and an interior of the inflatable element, the passageway may include a check valve that restricts reverse flow. The inflatable element is capable of being connected to a sand screen and the inflatable element can be inflated with the gravel laden slurry during a gravel packing of the well. The gravel packing of the well comprises pumping a gravel laden slurry into the well whereby a portion of the gravel laden slurry passes through the passageway and enters the inflatable element. The gravel laden slurry then dehydrates, leaving the inflatable element in an inflated condition filled with gravel. This method can comprise more than one inflatable elements, at least one of which is inflated with a gravel laden slurry. The inflatable element is capable of being used to seal the annulus of the well and isolate a first zone from a second zone or to seal off lower depths in the well.

Yet another embodiment is a method of completing a well comprising providing a sand screen completion having at least one inflatable element therein, gravel packing at least a portion of the well with a gravel slurry, and inflating the inflatable element with the gravel slurry. The inflatable element can comprise a passageway communicating between an exterior and an interior of the inflatable element. The passageway is capable of comprising a check valve that restricts reverse flow. The inflatable element may be connected to a sand screen and the inflatable element is made so it is capable of being inflated with the gravel slurry during a gravel packing of the well. The gravel packing of the well comprises pumping the gravel slurry into the well wherein a portion of the gravel slurry passes through the passageway and enters the inflatable element. The gravel slurry then dehydrates, leaving the inflatable element in an inflated condition filled with gravel. This method can comprise more than one inflatable elements, at least one of which is inflated with a gravel slurry. The inflatable element is capable of being used to seal the annulus of the well and isolate a first zone from a second zone or to seal off lower depths in the well.

Still another embodiment is a method of completing a wellbore by providing an apparatus comprising a tubular body member, a bladder, and a conduit. The apparatus is positioned within the wellbore and a gravel laden slurry is plumped into the wellbore. At least a portion of the slurry passes through the conduit into the bladder. The bladder is capable of expanding and forming a seal between the tubular body and a wellbore wall. The tubular body can comprise at least one aperture that assists the dehydration of the gravel laden slurry within the bladder. The apertures allow fluid communication while restricting particulate communication. The gravel pack slurry within the bladder can dehydrate, leaving the bladder filled with gravel in an expanded state.

Another particular embodiment is a method of completing a wellbore by providing an apparatus comprising a tubular body member having first, second and third segments, each segment having an exterior and a longitudinal bore extending therethrough. An annular bladder surrounds the second segment of the tubular body, the bladder having a wall and an interior. A conduit is located adjacent to the exterior of the first and third segments and extends through the wall of the bladder, the conduit capable of comprising a check valve to restrict reverse flow. The apparatus is positioned within the wellbore and a gravel laden slurry is pumped into the wellbore. At least a portion of the slurry passes through the conduit into the bladder. The bladder is capable of expansion and forming a seal between the tubular body and the wellbore wall. The second segment of the tubular body can further comprise at least one aperture that assists the dehydration of the gravel laden slurry within the bladder. The apertures allow fluid communication between the interior of the bladder and the longitudinal bore of the tubular body member while restricting particulate communication. The gravel pack slurry within the bladder can dehydrate, leaving the bladder filled with gravel in an expanded state.

Yet another embodiment is a method of completing a wellbore by providing an apparatus comprising a tubular body having a longitudinal bore, an expandable bladder attached to the tubular body and a conduit providing communication between the bladder and the exterior of the tubular body. The apparatus is positioned within the wellbore and a gravel laden slurry is pumped into the wellbore. At least a portion of the slurry passes through the conduit into the bladder, the conduit capable of comprising a check valve to restrict reverse flow. The bladder can expand and form a seal between the tubular body and the wellbore wall. The tubular body may further comprise at least one aperture that assists the dehydration of the gravel laden slurry within the bladder. The apertures allow fluid communication between the interior of the bladder and the longitudinal bore of the tubular body member while restricting particulate communication. The gravel pack slurry within the bladder can dehydrate, leaving the bladder filled with gravel in an expanded state.

The present invention describes tools and methods of completing a wellbore that comprise an inflatable packer element that is adapted for inflation by gravel. This invention offers a number of benefits over conventional wellbore completion tools. One advantage is the ability to inflate the gravel inflatable element at the same time as when performing a gravel pack completion on the well, thus saving time and expense. A further benefit is the ability to utilize carrier fluids that are compatible with the well completion, thus minimizing the risk of formation damage as compared to methods of inflating an isolation packer using cement, curable resins or mud based fluid. Another benefit is that since the inflatable element is filled with a solid material instead of a liquid, a loss of hydraulic seal will not necessarily result in the deflation of the tool, thus improving the reliability of the inflatable packer.

DESCRIPTION OF ILLUSTRATIVE EMBODIMENTS

Figure 1:
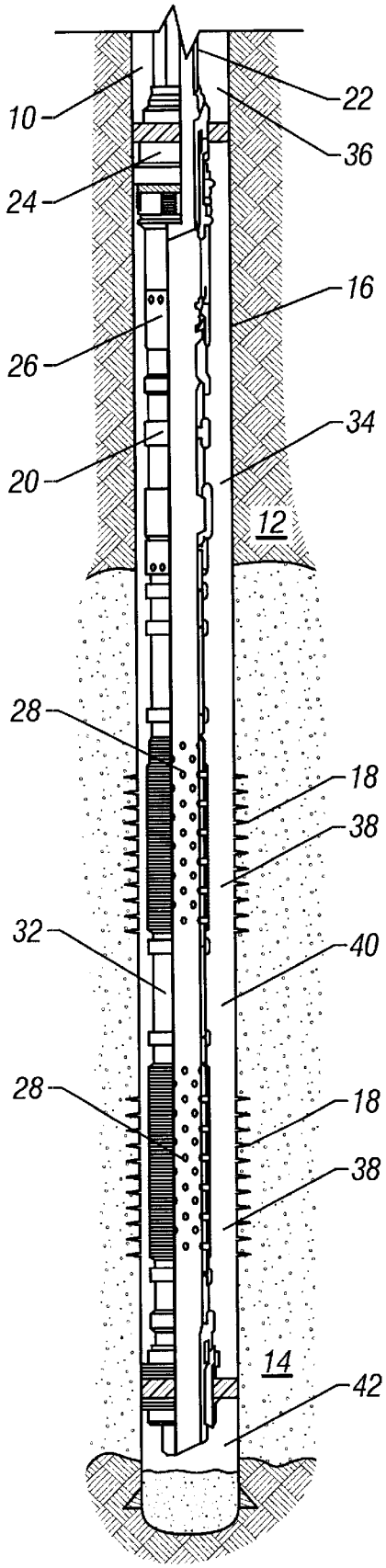
FIG. 1 (Prior Art)
FIG. 1 is a cross section of a wellbore showing a typical gravel pack completion apparatus. This illustration is of prior art.

Referring to the attached drawings, FIG. 1 is a depiction of the prior art and illustrates a wellbore 10 that has penetrated a subterranean zone 12 that includes a productive formation 14. The wellbore 10 has a casing 16 that has been cemented in place. The casing 16 has a plurality of perforations 18 which allow fluid communication between the wellbore 10 and the productive formation 14. A well tool 20 is positioned within the casing 16 in a position adjacent to the productive formation 14, which is to be gravel packed.

Figure 5:
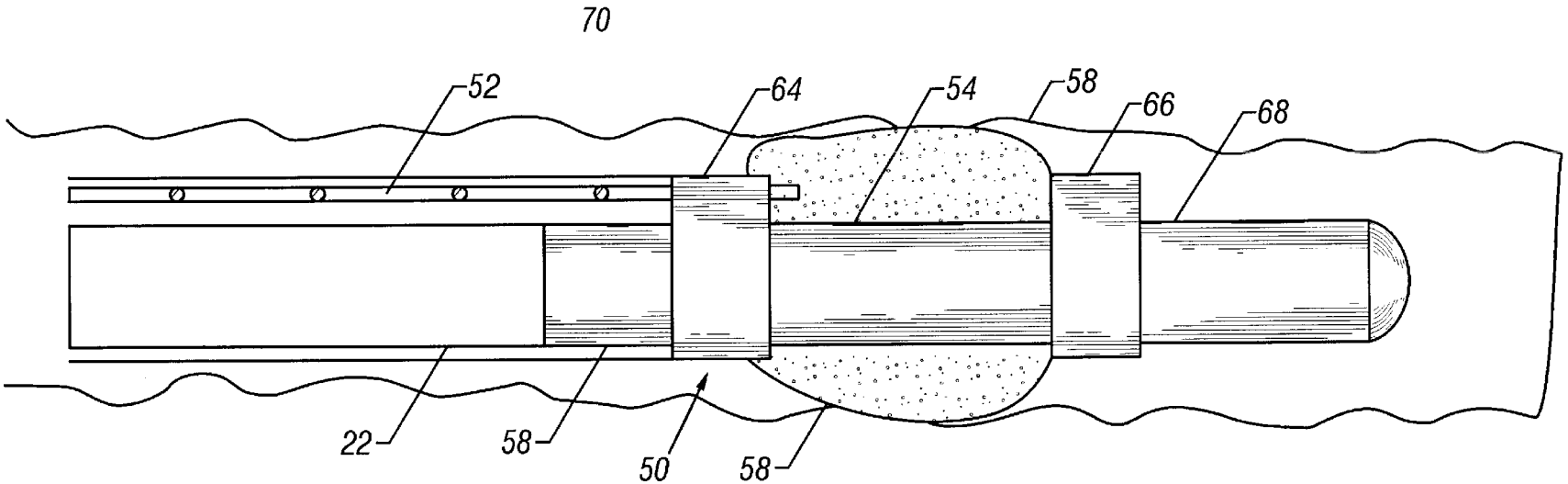
FIG. 5 shows an embodiment of the present invention used in an openhole completion.
Figure 7:
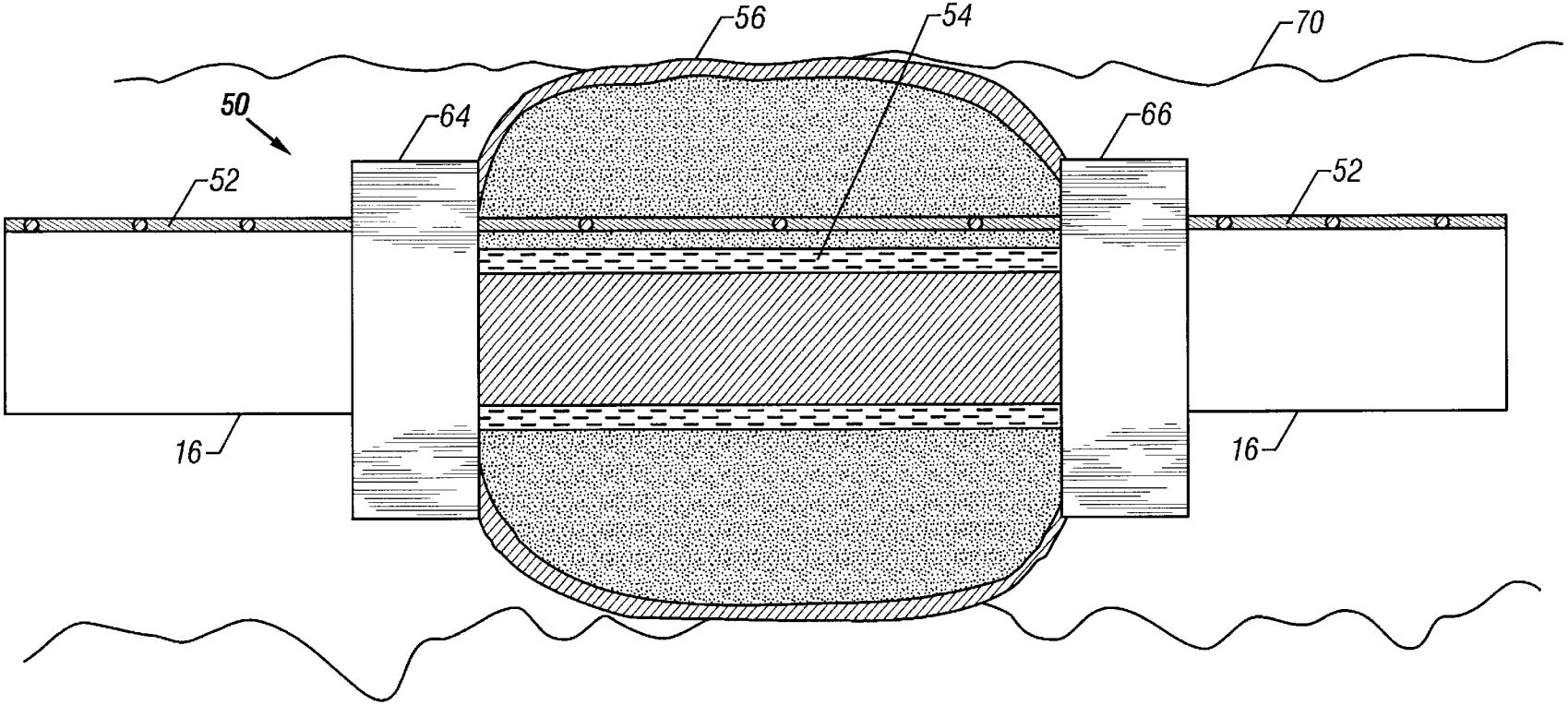
FIG. 7 shows an embodiment of the present invention used in an openhole completion.

The present invention can be utilized in both cased wells and open hole completions. For ease of illustration of the relative positions of the producing zones in FIGS. 1–3, a cased well having perforations will be used. More detailed illustrations of the invention being utilized in an open hole completion are shown in FIGS. 5 and 7.

The well tool 20 comprises a tubular member 22 attached to a production packer 24, a cross-over 26, and one or more screen elements 28. Blank sections 32 of pipe may be used to properly space the relative positions of each of the components. An annulus area 34 is created between each of the components and the wellbore casing 16. The combination of the well tool 20 and the tubular string extending from the well tool to the surface can be referred to as the production string.

In a gravel pack operation the packer 24 is set to ensure a seal between the tubular member 22 and the casing 16. Gravel laden slurry is pumped down the tubular member 22, exits the tubular member through ports in the cross-over 26 and enters the annulus area 34. In one typical embodiment the particulate matter (gravel) in the slurry has an average particle size between about 40/60 mesh–12/20 mesh, although other sizes may be used. Slurry dehydration occurs when the carrier fluid leaves the slurry. The carrier fluid can leave the slurry by way of the perforations 18 and enter the formation 14. The carrier fluid can also leave the slurry by way of the screen elements 28 and enter the tubular member 22. The carrier fluid flows up through the tubular member 22 until the cross-over 26 places it in the annulus area 36 above the production packer 24 where it can leave the wellbore 10 at the surface. Upon slurry dehydration the gravel grains should pack tightly together. The final gravel filled annulus area is referred to as a gravel pack.

An area that is prone to developing a void during a gravel pack operation is the area 42 below the lowest screen element 28, sometimes referred to as the "sump". A gravel pack void in the sump 42 is particularly problematic in vertical wells in that it can allow the gravel from above to settle and fall into the voided sump.

A sump area may also exist in horizontal open hole completions. This would occur where the well is drilled through a non-productive zone after drilling through a productive zone, leaving a large open hole section that could be described as a sump area. Traditionally in this situation, a pre-gravel pack trip would be undertaken to isolate the sump area with a cement plug or an open hole packer. These additional steps are costly, time consuming and are often difficult to perform and unreliable in their outcome. The present invention provides a means of achieving the desired results in the same trip into the well as the gravel pack operation.

Production of fluids from the productive formation 14 can agitate or "fluff" the gravel pack and initiate the gravel to migrate and settle within the sump 42. This can lead to the creation of voids in the annulus areas 38 adjacent to the screen elements 28 and undermine the effectiveness of the entire well completion.

As used herein, the term "screen" refers to wire wrapped screens, mechanical type screens and other filtering mechanisms typically employed with sand screens. Sand screens need to be have openings small enough to restrict gravel flow, often having gaps in the 60–120 mesh range, but other sizes may be used. The screen element 28 can be referred to as a sand screen. Screens of various types are produced by US Filter/Johnson Screen, among others, and are commonly known to those skilled in the art.

Figure 2:
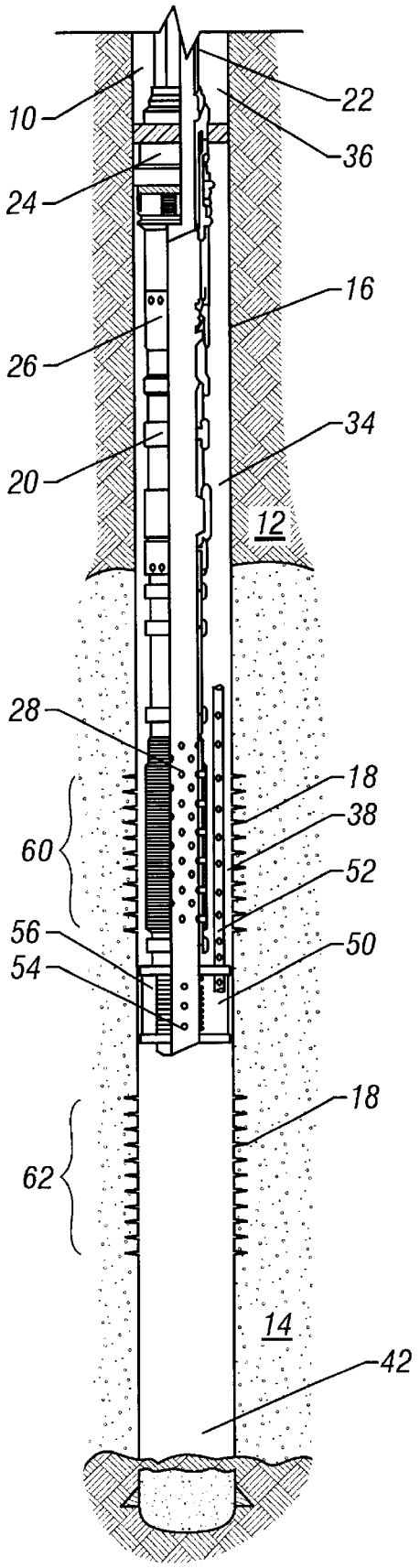
FIG. 2 is a cross section of a wellbore showing a gravel pack completion apparatus that includes an embodiment of the present invention.

FIG. 2 illustrates one particular embodiment of the present invention where an upper set of perforations 60 will be completed utilizing a gravel pack completion. A lower set of perforations 62 will not be completed, but will be isolated from the upper set of perforations 60. A gravel inflated isolation packer 50 is run into the wellbore 10 below the lowest screen element 28. A conduit 52 extends from the gravel inflated isolation packer 50 and provides communication with the annulus area 38 that will be gravel packed. The conduit 52 allows the gravel laden slurry to enter an expandable bladder 56 that provides the sealing mechanism between the tubular member 22 and the casing 16. The conduit is sometimes referred to as a shunt tube. The gravel laden slurry enters and expands the bladder 56 of the gravel inflated isolation packer 50. Fluid from the gravel laden slurry passes through a screen 54 that allows fluid to pass into the longitudinal bore of the tubular member 22 but restricts the flow of the gravel. The screen 54 enables the gravel laden slurry within the gravel inflated isolation packer 50 to dehydrate and to fill the expanded bladder 56 with tightly packed gravel.

A conduit 52 is just one way of enabling the communication of the gravel laden slurry to enter the gravel inflated isolation packer 50. Other embodiments can be used, such as simply one or more openings within the top of the gravel inflated isolation packer 50, or a shunt tube type apparatus. All of these embodiments could include a check valve device to prevent any reverse flow out of the gravel inflated isolation packer 50.

The terms "gravel inflated isolation packer", "gravel inflatable element", or other similar phrases used in this application describe an inflatable element that is capable of being inflated by gravel. The inflation of the element will typically be done with a gravel laden slurry that will subsequently dehydrate, leaving a quantity of gravel within the element. The extent of expansion of the element may change during the filling and the dehydration process, and full inflation is often not necessary to retain the element in a sufficiently expanded state. The inflation of the element can be performed in conjunction with a gravel pack completion operation of the well.

The bladder 56 is typically constructed utilizing an inner elastomeric element that retains the pressurized fluid that is used to inflate the packer. In the present invention the elastomeric element would not have to necessarily be impervious to fluid, since the containment of pressurized fluid is not required to retain the packer in an inflated state. The bladder can comprise more than one layer of material, such as utilizing an expandable mesh as an outer layer for durability. Often a plurality of metal reinforcing members can be located in the annulus between the elastomeric element and the outer expandable mesh, these provide additional strength to the packer and can improve reliability. The typical construction can be in the manner of conventional packers, these methods and materials being well known to those skilled in the art.

Figure 3:
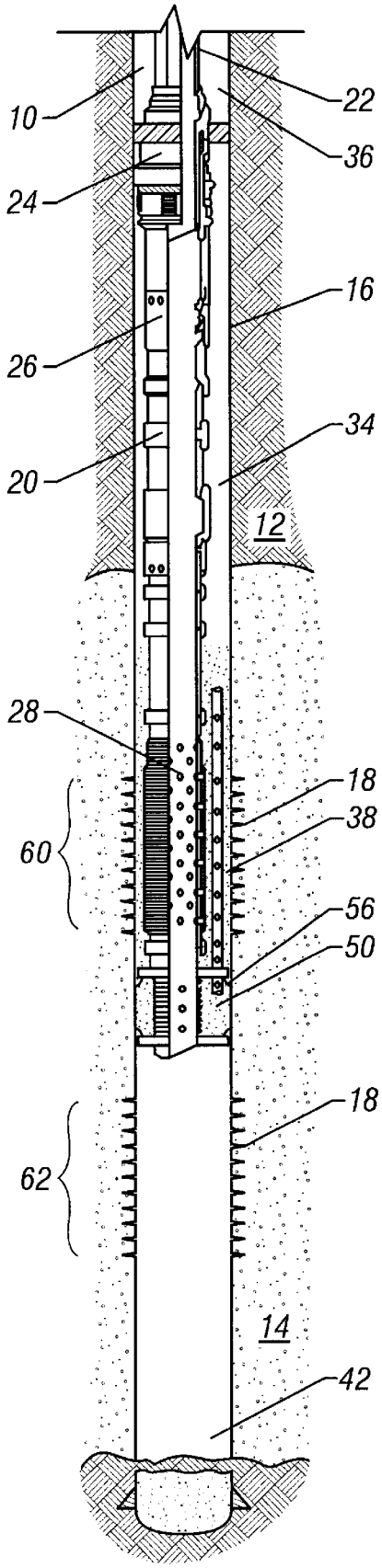
FIG. 3 is a cross section of a wellbore showing a gravel pack completion that utilizing an embodiment of the present invention.

FIG. 3 illustrates the embodiment of the invention as described above after a gravel pack operation has been performed. The bladder 56 of the gravel inflated isolation packer 50 is expanded and provides a seal between the tubular member 22 and the casing 16. The gravel inflated isolation packer 50 is filled with tightly packed gravel and therefore does not have to rely on fluid pressure to remain inflated. The upper set of perforations 60 have been properly gravel packed and protected from the producing formation 14. The gravel pack on the upper perforations 60 is protected from settling into the sump area 42 by the expanded gravel inflated isolation packer 50. The gravel inflated isolation packer 50 acts to isolate the lower set of perforations 62 from the gravel pack completed upper set of perforations 60.

The gravel inflated isolation packer 50 acts to isolate a first zone from a second zone within the well. In this particular illustration an annulus area that is gravel packed is being isolated from a lower section of the well that is not gravel packed. Other embodiments can be used to isolate two separate gravel packed annulus areas, a gravel packed annulus area from a sump area or other combinations such as these. Another embodiment can be to isolate a lateral wellbore from the main wellbore, to isolate multiple lateral wellbores from themselves, or to effectively shorten the length of a lateral wellbore being gravel packed.

The ability to inflate the gravel inflated isolation packer 50 during a gravel pack completion can save time and expense by eliminating an additional trip into the well. By filling the expanded gravel inflated isolation packer 50 with packed gravel, the seal between the tubular member 22 and the casing 16 does not rely on the holding of a hydraulic pressure within the bladder 56. A loss of fluid pressure within the gravel inflated isolation packer 50 will not deflate the gravel filled bladder 56. Even the rupture of the bladder 56 will likely not lead to the loss of gravel sufficient to deflate the bladder 56 to a point where the seal between the tubular member 22 and the casing 16 would be lost. The term "seal" as used in this application means a substantial seal. Some wellbore conditions may not permit a total liquid tight seal. This could be due to the wellbore shape, the condition of the casing, the type of formation or other factors. Some amount of leakage may be acceptable in certain embodiments of the invention.

FIG. 3 shows the invention used adjacent to a single gravel packed zone. The invention can also be positioned between two gravel packed zones, whereby the invention is isolating the two gravel packed zones from each other. This embodiment can be used to selectively work on or produce from the separate zones.

In another embodiment the invention is placed below the lowest perforation or at the bottom of the well. This embodiment can be used to isolate the lower areas from the completed zones without permanently reducing the total depth of the well. In this application, the well could be functionally plugged back to where the invention was located, while leaving the possibility of removal of the invention and the completion of deeper zones in the future.

Figure 4A:
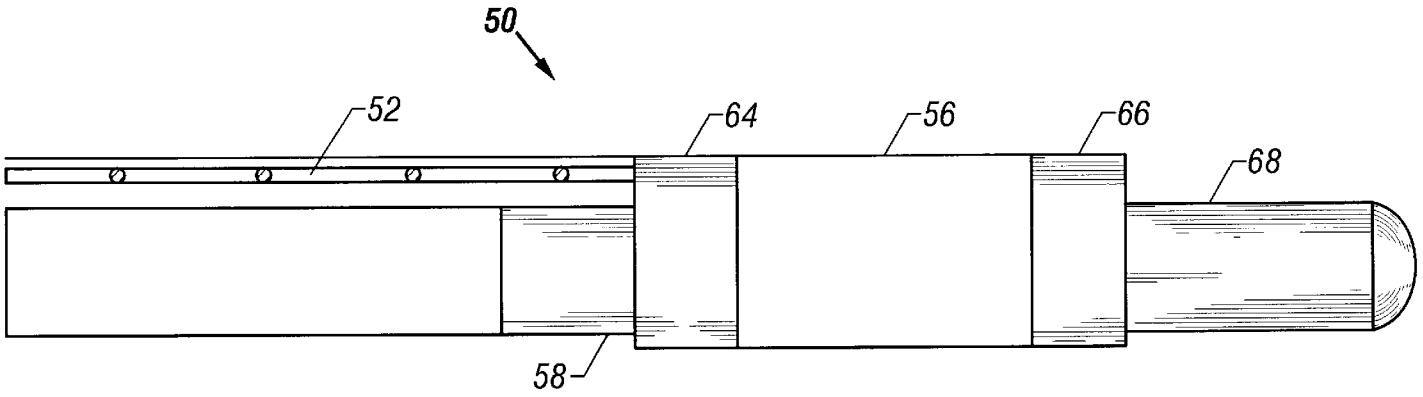
FIGS. 4A and 4B show alternative embodiments of the present invention.

FIG. 4A illustrates an embodiment of the gravel inflated isolation packer 50 comprising a conduit 52, a bladder 56, a tubular body 58, an upper packer head 64, a lower packer head 66, and a shoe assembly 68. The conduit 52 allows gravel laden fluid to travel from the exterior of the tubular body 58 and enter the bladder 56. The bladder is 56 can then expand and be filled with the gravel laden slurry. Upon subsequent dehydration of the slurry, the bladder 56 will be in its expanded configuration filled with gravel. The upper packer head 64 and the lower packer head 66 in this embodiment act as a connection between the bladder 56 and the tubular body 58. This embodiment can be used to seal off a lower portion of a well from an upper productive portion of a well, such as shown in FIGS. 2 and 3.

Figure 4B:
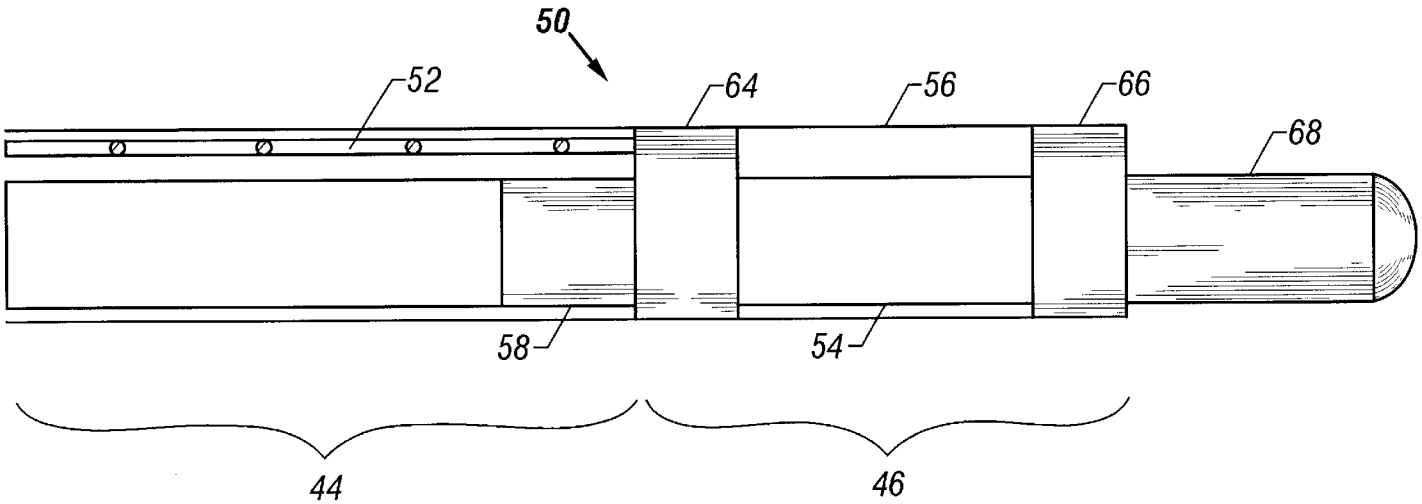

FIG. 4B is the embodiment illustrated in FIG. 4A showing the interior of the gravel inflated isolation packer 50. The conduit 52 is shown extending into the bladder 56. A screen 54 is enclosed within the bladder 56 that allows fluid to pass but restricts the movement of gravel through its apertures. The screen provides a path for the carrier fluid to travel from the slurry during dehydration into the tubular body 58 where it can be circulated out of the well. In this way the bladder 56 can be filled with gravel and remain in its expanded state. The segment of the tubular body 58 that does not contain apertures can be referred to as the first segment 44, while the segment having the apertures can be referred to as the second segment 46. In FIG. 4B the conduit 52 provides a pathway for communication between the first segment 44 and the second segment 46.

FIG. 5 illustrates the embodiment illustrated in FIG. 4B in an inflated state within an openhole wellbore wall 70. The bladder 56 is inflated and filled with gravel, providing a seal between the tubular member 22 and the wellbore wall 70.

Figure 6:
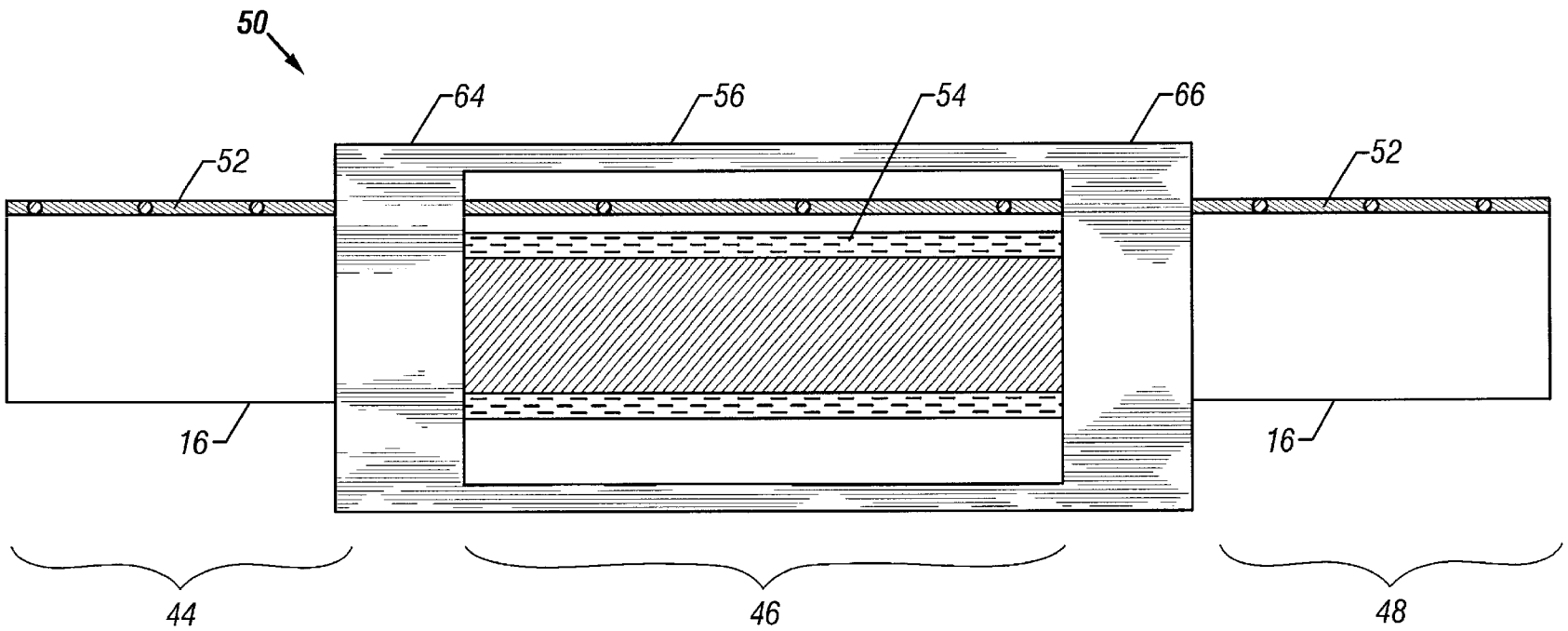
FIG. 6 shows an alternative embodiment of the present invention.

FIG. 6 illustrates an embodiment of the gravel inflated isolation packer 50 utilized as an external casing packer. This embodiment comprises a conduit 52, a bladder 56, an upper packer head 64, a lower packer head 66, and a screen 54 that allows fluid to pass into the longitudinal bore of the screen 54, but restricts the flow of the gravel. This illustration shows an embodiment of the present invention wherein the conduit 52 extends out both the upper packer head 64 and the lower packer head 66, and where the gravel inflated isolation packer 50 is attached to a string of casing 16. The segments of the casing 16 that does not contain apertures can be referred to as the first segment 44 and the third segment 48, while the segment having the apertures can be referred to as the second segment 46. In FIG. 6 the conduit 52 provides a pathway for communication between the first segment 44, the second segment 46, and the third segment 48.

FIG. 7 shows the gravel inflated isolation packer 50 as illustrated in FIG. 6 and described above with the bladder 56 in an inflated state and filled with gravel. The inflated bladder 56 forms a seal between the casing 16 and the wellbore wall 70.

For ease of installation and to ensure proper placement relative to the components of the well tool 20, the conduit 52 that extends from the gravel inflated isolation packer 50 will typically be attached to the exterior of the well tool 20 in some manner, such as by welding. It is also possible for the conduit 52 to be incorporated within the screen elements 28. The screen elements 28 can have a larger diameter than the blank sections 32 located between them. The conduit 52 could then be incorporated within the screen elements 28, extending longitudinally between the screen elements 28 and radially offset from the blank section 32 located between the screen elements 28.

The discussion and illustrations within this application may refer to a vertical wellbore that has casing cemented in place and comprises casing perforations to enable communication between the wellbore and the productive formation. It should be understood that the present invention can also be utilized with wells that are not cased and likewise to wellbores that have an orientation that is deviated from vertical.

The particular embodiments disclosed herein are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A well completion, comprising:

a sand screen; and a gravel inflatable element having a portion capable of allowing a fluid to pass therethrough while retaining the gravel therein.

2. The well completion of claim 1, wherein the gravel inflatable element is capable of movement between a deflated state and an inflated state, and the gravel inflatable element is capable of being inflated by a gravel laden slurry.

3. The well completion of claim 2, wherein the gravel inflatable element comprises a top end, a bottom end, an interior, and a passageway allowing communication of the gravel laden slurry between the top end of the gravel inflatable element and the interior of the gravel inflatable element.

4. The well completion of claim 3, wherein the gravel inflatable element further comprises a passageway allowing communication of the gravel laden slurry between the bottom end of the gravel inflatable element and the interior of the gravel inflatable element.

5. The well completion of claim 4, wherein the passageway comprises a check valve that restricts reverse flow.

6. The well completion of claim 1, wherein the gravel inflatable element is placed below the sand screen and isolates the sand screen from the well below the gravel inflatable element.

7. A well completion, comprising:

a sand screen; and a gravel inflatable element, wherein the well completion comprises a first sand screen and a second sand screen and the gravel inflatable element isolates the first sand screen from the second sand screen.

8. A well tool, comprising:

an inflatable element;

a passageway communicating between an exterior and an interior of the inflatable element, wherein the inflatable element is adapted for inflation by gravel provided through the passageway; and wherein the well tool further comprises a portion capable of allowing fluid to flow therethrough from the inflatable element while retaining the gravel within the interior of the inflatable element.

9. The well tool of claim 8, wherein the passageway comprises at least one shunt tube.

10. The well tool of claim 8, wherein the well tool comprises at least one sand screen and the inflatable element is placed below the lowermost sand screen and isolates the lowermost sand screen from the well below the inflatable element.

11. The well completion of claim 8, wherein the passageway comprises a check valve that restricts reverse flow.

12. The well completion of claim 8, wherein a tubular body is attached to the inflatable element.

13. A well tool, comprising:

an inflatable element;

a passageway communicating between an exterior and an interior of the inflatable element, wherein the inflatable element is adapted for inflation by gravel provided through the passageway; and wherein the well tool comprises a first sand screen and a second sand screen and the inflatable element isolates the first sand screen from the second sand screen.

14. An apparatus comprising:

a tubular body member having first and second segments, each segment having an exterior and a longitudinal bore extending therethrough;

a bladder surrounding the second segment of the tubular body, the bladder having a wall and an interior;

a conduit located adjacent the exterior of the first segment and extending through the wall of the bladder element; and wherein the conduit allows a gravel laden slurry to enter and expand the bladder.

15. The well completion of claim 14, wherein the conduit comprises a check valve that restricts reverse flow.

16. The apparatus of claim 14, wherein the bladder is expandable in a radial direction.

17. The apparatus of claim 16, wherein the bladder is attached to the tubular body member.

18. The apparatus of claim 17, wherein the bladder has an upper end and a lower end, and both the upper end and the lower end are connected to the tubular body member.

19. The apparatus of claim 18, wherein the second tubular body segment comprises an upper packer head and a lower packer head, and the bladder upper end is connected to the upper packer head and the bladder lower end is connected to the lower packer head.

20. The apparatus of claim 19, wherein the conduit extends through the upper packer head and communicates between the exterior of the first segment of the tubular body member and the interior of the bladder.

21. The apparatus of claim 19, further comprising a third segment of the tubular body member, wherein the conduit extends through the upper and lower packer heads and communicates between the exterior of the first and third segments of the tubular body member and the interior of the bladder.

22. The apparatus of claim 14, wherein at least one aperture in the second segment of the tubular body member provides fluid communication between the longitudinal bore of the tubular body member and the interior of the bladder.

23. The apparatus of claim 22, wherein the at least one aperture allows fluid communication but restricts particulate communication.

24. The apparatus of claim 14, wherein the conduit enables communication between the exterior of the first segment of the tubular body member and the interior of the bladder.

25. The apparatus of claim 14, further comprising a third segment of the tubular body member wherein the conduit enables communication between the exterior of the first and third segments with the interior of the bladder.

26. The apparatus of claim 14, wherein the bladder comprises a material that allows the passage of fluid but restricts the passage of particulates.

27. A wellbore isolation tool comprising:

a tubular body having a longitudinal bore therethrough;

an expandable bladder attached to the tubular body;

a conduit providing communication between the expandable bladder and the exterior of the tubular body; and wherein the conduit allows a gravel laden slurry to enter and expand the bladder.

28. The tool of claim 27, wherein the conduit comprises a check valve that restricts reverse flow.

29. The tool of claim 28, wherein the bladder has an upper end and a lower end, and both the upper end and the lower end are connected to the tubular body.

30. The tool of claim 29, wherein the expandable bladder encloses a portion of the tubular body comprising at least one aperture, the at least one aperture assisting the dehydration of the gravel laden slurry by allowing fluid flow from the gravel laden slurry within the expandable bladder through the at least one aperture in the tubular body and into the longitudinal bore of the tubular body.

31. The apparatus of claim 30, wherein the at least one aperture allows fluid communication but restricts particulate communication.

32. An apparatus comprising:

a tubular body member having first, second and third segments, the first and third segments being on opposite ends of the second segment, each segment having an exterior and a longitudinal bore extending therethrough;

a bladder surrounding the second segment of the tubular body, the bladder having a wall and an interior;

a conduit located adjacent the first and third segments and extending through the wall of the bladder; and wherein the conduit allows a gravel laden slurry to enter and expand the bladder.

33. The apparatus of claim 32, wherein the conduit enables communication between the exterior of the first and third segments with the interior of the bladder.

34. The apparatus of claim 33, wherein during a gravel pack completion of a wellbore the conduit allows gravel laden slurry to communicate between the exterior of the first and third segments and the interior of the bladder.

35. The apparatus of claim 34, wherein the conduit comprises a check valve that restricts reverse flow.

36. The apparatus of claim 32, wherein the second segment of the tubular body comprises at least one aperture that assists the dehydration of the gravel laden slurry within the bladder.

37. The apparatus of claim 36, wherein the at least one aperture allows fluid communication but restricts particulate communication.

38. The apparatus of claim 37, wherein the bladder is capable of radial expansion upon being filled with gravel.

39. The apparatus of claim 38, wherein the expanded bladder forms a seal between the tubular body and the wellbore wall.

40. A method of sealing an annulus in a well, comprising:

expanding an inflatable element with a gravel laden slurry, the inflatable element comprising a passageway communicating between an exterior and an interior of the inflatable element and wherein the passageway comprises a check valve that restricts reverse flow;

the inflatable element is connected to a sand screen and the inflatable element is inflated with the gravel laden slurry during a gravel packing of the well;

the gravel packing of the well comprises pumping the gravel laden slurry into the well wherein at least a portion of the gravel laden slurry passes through the passageway and enters the inflatable element.

41. The method of claim 40, wherein the gravel laden slurry dehydrates leaving the inflatable element in an inflated condition filled with gravel.

42. The method of claim 41, comprising more than one inflatable elements and at least one of the inflatable elements is inflated with a gravel laden slurry.

43. The method of claim 41, wherein the inflatable element seals the annulus of the well and isolates a first zone from a second zone.

44. The method of claim 41, wherein the inflatable element is used to seal off lower depths in the well.

45. A method of completing a well, comprising:

providing a sand screen completion having at least one inflatable element therein;

gravel packing at least a portion of the well with a gravel slurry; and inflating the inflatable element with the gravel slurry.

46. The method of claim 45, wherein the inflatable element comprises a passageway communicating between an exterior and an interior of the inflatable element.

47. The method of claim 46, wherein the passageway comprises a check valve that restricts reverse flow.

48. The method of claim 45, wherein the inflatable element is connected to a sand screen and the inflatable element is inflated with the gravel slurry during a gravel packing of the well.

49. The method of claim 48, wherein the gravel packing of the well comprises pumping the gravel slurry into the well wherein at least a portion of the gravel slurry passes through the passageway and enters the inflatable element.

50. The method of claim 49, wherein the gravel slurry dehydrates, leaving the inflatable element in an inflated condition filled with gravel.

51. The method of claim 49, comprising more than one inflatable elements and at least one of the inflatable elements is inflated with a gravel slurry.

52. The method of claim 49, wherein the inflatable element seals the annulus of the well and isolates a first zone from a second zone.

53. The method of claim 49, wherein the inflatable element is used to seal off lower depths in the well.

54. A method of completing a wellbore comprising:

providing an apparatus comprising: a tubular body member; a bladder; and a conduit;

positioning the apparatus within the wellbore;

pumping a gravel laden slurry into the wellbore, wherein at least a portion of the slurry passes through the conduit into the bladder;

wherein the bladder expands and forms a seal between the tubular body and a wellbore wall;

wherein the tubular body comprises at least one aperture that assists the dehydration of the gravel laden slurry within the bladder; and the at least one aperture allows fluid communication but restricts particulate communication.

55. The method of claim 54, wherein the gravel laden slurry within the bladder dehydrates, leaving the bladder filled with gravel in an expanded state.

56. The method of claim 54, wherein the conduit comprises a check valve that restricts reverse flow.

57. A method of completing a wellbore comprising:

providing an apparatus comprising: a tubular body member having first, second and third segments, each segment having an exterior and a longitudinal bore extending therethrough; an annular bladder surrounding the second segment of the tubular body, the bladder having a wall and an interior; and a conduit located adjacent the exterior of the first and third segments and extending through the wall of the bladder;

positioning the apparatus within the wellbore; and pumping a gravel laden slurry into the wellbore, wherein at least a portion of the slurry passes through the conduit into the bladder.

58. The method of claim 57, wherein the bladder expands and forms a seal between the tubular body and the wellbore wall.

59. The method of claim 57, wherein the second segment of the tubular body further comprises at least one aperture that assists the dehydration of the gravel laden slurry within the bladder, the at least one aperture allowing fluid communication between the interior of the bladder and the longitudinal bore of the tubular body member while restricting particulate communication.

60. The method of claim 57, wherein the gravel laden slurry within the bladder dehydrates, leaving the bladder filled with gravel in an expanded state.

61. The method of claim 57, wherein the conduit comprises a check valve that restricts reverse flow.

62. A method of completing a wellbore comprising:

providing an apparatus comprising: a tubular body having a longitudinal bore therethrough; an expandable bladder attached to the tubular body; a conduit providing communication between the bladder and the exterior of the tubular body;

positioning the apparatus within the wellbore; and pumping a gravel laden slurry into the wellbore, wherein at least a portion of the slurry passes through the conduit into the bladder.

63. The method of claim 62, wherein the bladder expands and forms a seal between the tubular body and the wellbore wall.

64. The method of claim 62, wherein the second segment of the tubular body further comprises at least one aperture that assists the dehydration of the gravel laden slurry within the bladder, the at least one aperture allowing fluid communication between the interior of the bladder and the longitudinal bore of the tubular body member while restricting particulate communication.

65. The method of claim 62, wherein the gravel laden slurry within the bladder dehydrates, leaving the bladder filled with gravel in an expanded state.

66. The method of claim 62, wherein the conduit comprises a check valve that restricts reverse flow.

* * * * *